US012595981B2

(12) United States Patent
Blata

(10) Patent No.: US 12,595,981 B2
(45) Date of Patent: Apr. 7, 2026

(54) BRAKING MECHANISM FOR A GUN

(71) Applicant: Pavel Blata, Blansko (CZ)

(72) Inventor: Pavel Blata, Blansko (CZ)

( * ) Notice: Subject to any disclaimer, the term of this patent is extended or adjusted under 35 U.S.C. 154(b) by 0 days.

(21) Appl. No.: 18/844,811

(22) PCT Filed: Mar. 1, 2023

(86) PCT No.: PCT/CZ2023/000007
§ 371 (c)(1),
(2) Date: Sep. 6, 2024

(87) PCT Pub. No.: WO2023/169612
PCT Pub. Date: Sep. 14, 2023

(65) Prior Publication Data

US 2025/0207874 A1 Jun. 26, 2025

(30) Foreign Application Priority Data

Mar. 7, 2022 (CZ) ..... CZ2022-101

(51) Int. Cl.
*F41A 3/44* (2006.01)

(52) U.S. Cl.
CPC ..... *F41A 3/44* (2013.01)

(58) Field of Classification Search
CPC ..... F41A 3/44; F41A 3/46
(Continued)

(56) References Cited

U.S. PATENT DOCUMENTS 3,848,510 A * 11/1974 Wolpert ..... F41A 3/46 89/173
5,447,092 A * 9/1995 Dobbins ..... F41A 3/46 42/16

(Continued)

FOREIGN PATENT DOCUMENTS

AT 510291 B1 3/2012
BE 493387 A 5/1950

(Continued)

OTHER PUBLICATIONS

International Search Report mailed May 19, 2023 in corresponding PCT International Application No. PCT/CZ2023/000007.

(Continued)

*Primary Examiner* — Bret Hayes
(74) *Attorney, Agent, or Firm* — OSTROLENK FABER LLP

(57) ABSTRACT

Braking mechanism for a gun includes a fork whose arms are abutted by supporting pins that abut on brake rollers. A breech that has vertical engagement grooves. Spring-loaded pins with compression springs are arranged against supporting pins. The body of the fork is terminated by a tapered tongue extending into a cavity which follows the fork. Behind the tongue a rod is arranged, which passes into the cavity in a sleeve. The sleeve is provided at one end with an end rod, which is provided at its face with a cylindrical ending arranged eccentrically below its center. The supporting pin is provided with a vertical elongated groove to accommodate the safety pin. In front of the trigger a locking lever of the control arm is placed. At the end is the control arm provided with a transverse beam, which is accommodated above the ending of the end rod.

1 Claim, 6 Drawing Sheets

(58) Field of Classification Search
USPC ..... 89/180, 187.01, 187.02
See application file for complete search history.

(56) References Cited

U.S. PATENT DOCUMENTS

| | | | | |
|---|---|---|---|---|
| 7,571,671 | B2 * | 8/2009 | Engel | F41A 5/16 89/174 |
| 8,807,010 | B2 | 8/2014 | Bubits | |
| 11,543,195 | B2 * | 1/2023 | Underwood | F41A 3/62 |
| 2003/0150322 | A1 * | 8/2003 | Barrett, Jr. | F41A 3/46 89/182 |
| 2007/0012170 | A1 * | 1/2007 | Spielberger | F41A 3/40 89/196 |
| 2011/0041680 | A1 | 2/2011 | Smirnov | |

FOREIGN PATENT DOCUMENTS

| | | | |
|---|---|---|---|
| CZ | 306 500 | B6 | 2/2017 |
| GB | 668117 | A | 3/1952 |

OTHER PUBLICATIONS

Written Opinion mailed May 19, 2023 in corresponding PCT International Application No. PCT/CZ2023/000007.

* cited by examiner

BRAKING MECHANISM FOR A GUN

CROSS-REFERENCE TO RELATED APPLICATIONS

The present application is a national phase application of PCT application serial no. PCT/CZ2023/000007, filed Mar. 1, 2023, which claims priority to Czech Republic Application No. PV 2022-101, filed Mar. 7, 2022, the contents of which are incorporated herein by reference.

TECHNICAL FIELD

The invention relates to the construction of a braking mechanism for a gun for damping of backlash.

STATE OF THE ART

In every gun, the breech mechanism plays an indispensable role, ensuring a smooth sequence of actions between each individual shot so that the shot is fired and the gun is restored to its pre-shot condition. The construction of functional parts of a gun is given by the fact that rapid combustion and expansion of gas occurs when the gas escapes from the barrel.

The breech mechanism is a set of elements that serve to close or lock the cartridge chamber at the time of firing. It is located at the rear of the barrel and holds the cartridge before and during firing. By pulling the trigger, the striker is released and its front part, the primer, initiates the ignition of the cartridge. When the shot is fired, powder gases are released. A channel is drilled into the barrel for the passage of these gases. A backlash spring, which is wound around the rod of the backlash spring guide, pushes the breech to the forward rest position and acts in the opposite direction to the backlash. The disadvantage of the above solution for guns with a large number of consecutive shots is significant heating of the gun. As the barrel temperature increases, mechanical wear by abrasion, wear by erosion, and dilation of bore diameter also increases. Dangerous from the point of view of overheating of the gun is especially the decrease in the strength of the barrel steel, which can lead to permanent deformation and damage. In addition, the strong return spring makes it difficult to manually cock the breech.

Document US 2011/0041680 presents a semi-automatic pistol comprising a frame, a barrel with a cartridge chamber, a cartridge feeding mechanism, a cartridge removal mechanism and a breech return spring. The breech-block is slidable parallel to the axis of the barrel and includes a firing mechanism consisting of a firing spring stop, a firing spring, a striker, a breech notch and support pads for the striker spring. The invention improves the accuracy of positioning of the striker when the spring loses its elasticity.

Document CZ 306 500 B1 presents a self-loading gun, the diagram of which is shown in FIG. 1, which comprises a frame on which a breech 59 is mounted, through the frontal part of which a barrel 54 passes, which is fixedly mounted in the frame without possibility of movement, while a backlash spring 52 of the breech 59 is mounted on a return spring guide 53 arranged under the barrel 54 and a mechanism for locking the breech 59 during firing is arranged in the front of the frame under the barrel 54. By pulling the trigger, the firing spring 57 is tensioned and at the end of the depression, the hammer 56 is released and pushes on the striker 55. The striker 55 initiates the ignition of the cartridge in the cartridge chamber 58 by its front end. A backlash spring 52 on the return spring guide 53 damps the backlash.

The aim of the invention is to provide a braking mechanism for a gun which would prevent the gun from heating up during repetitive firing and would effectively brake the breech without the need for a strong slide return spring which makes it difficult to manually cock the breech.

SUMMARY OF THE INVENTION

The above mentioned deficiencies are eliminated by a braking mechanism for a gun according to the invention, defined in the characterizing part of the claim 1.

BRIEF DESCRIPTION OF DRAWINGS

The invention will be further described using drawings, where.

DETAILED DESCRIPTION OF THE INVENTION

Figure 1:
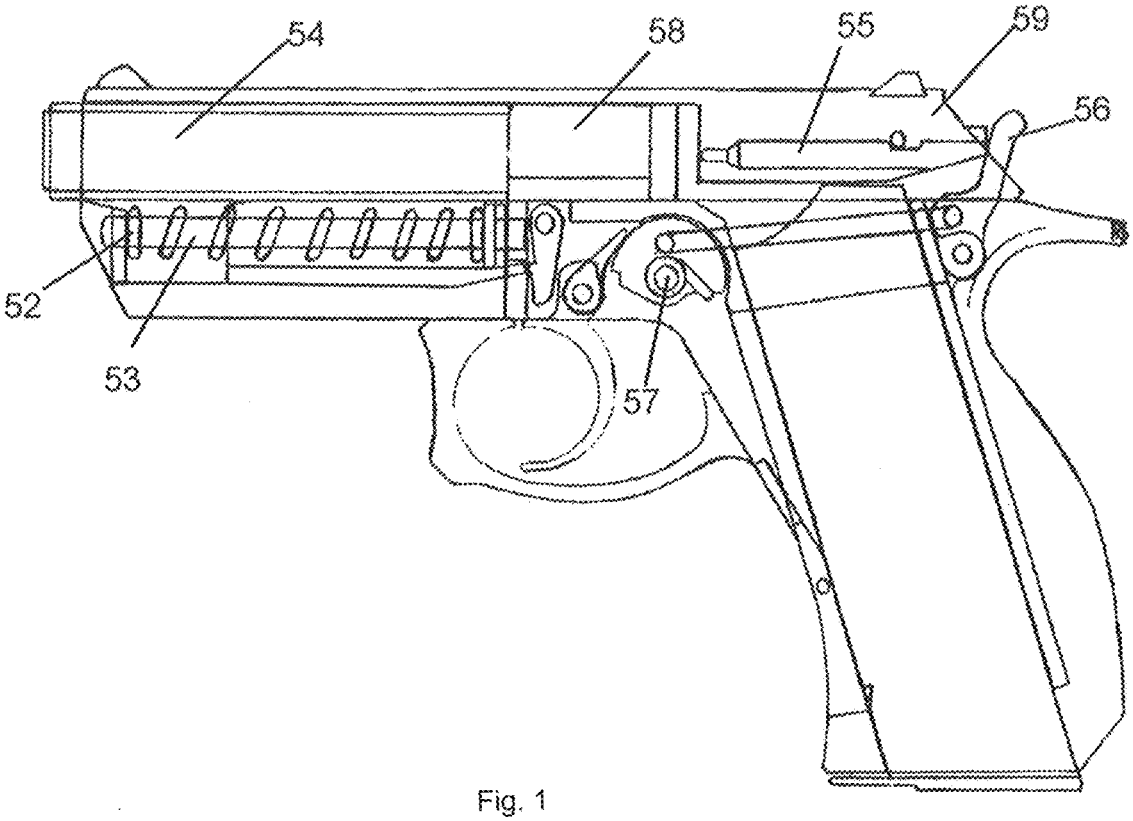
FIG. 1 shows an automatic gun according to the state of the art.
Figure 2:
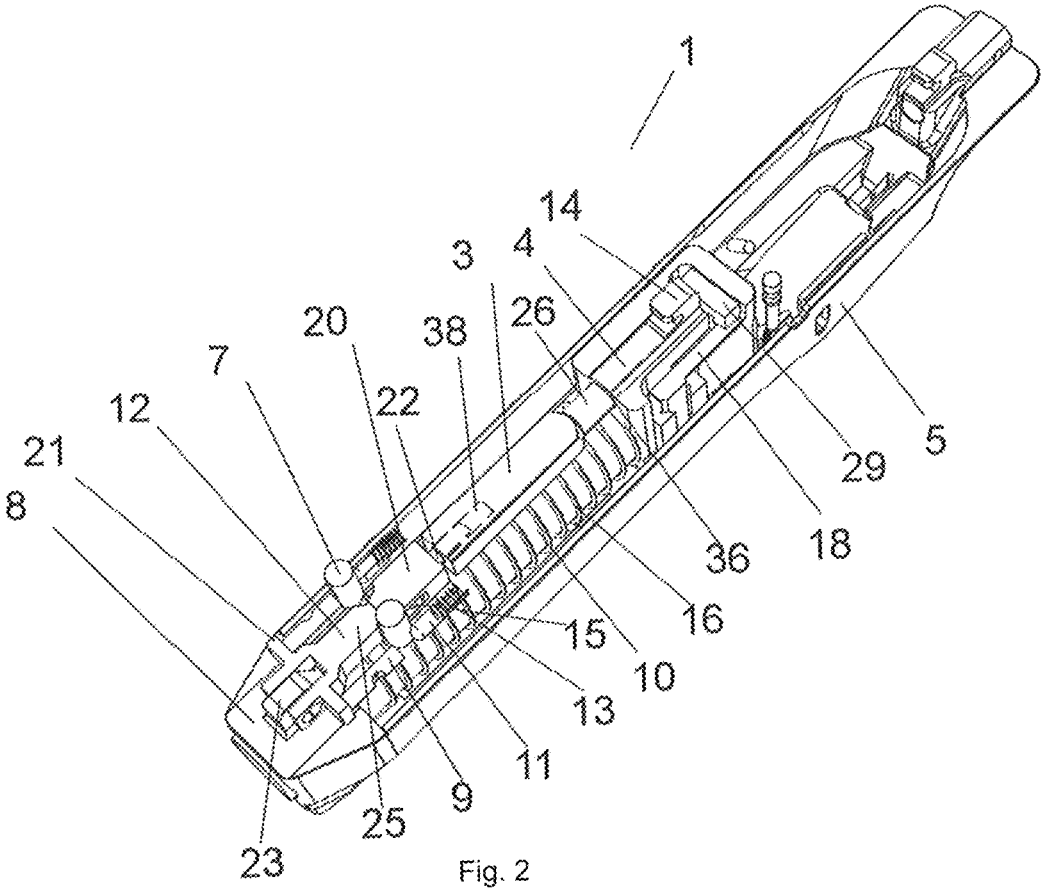
FIG. 2 is a perspective view into the barrel frame cavity of a gun according to the invention.

FIG. 2 is a perspective top view of the frame 5 of the gun 1 according to the invention. A barrel 10 is arranged in the cavity of the frame 5 for guiding the cartridge. Above this barrel 10, a braking mechanism is arranged which comprises a fork 12 which is mounted on the upper protrusion 23 of the head 8 of the frame 5 via a pin. The fork 12 has fork arms 21 projecting laterally on each side. On arms 21 of the fork 12 abut supporting pins 9, whereas from the other side are against these supporting pins 9 rounded spring-loaded pins 11 with compression springs 13 arranged. The pins 11, 9 are accommodated in the cavities 30, 39 of the breech 2, which can be seen in detail in FIG. 3. The supporting pins 9 interact with brake rollers 7. Brake rollers 7 are also partially disposed in the vertical engagement grooves 24 on the flank of the breech 2, and these engagement grooves 24 are part of the vertical shaped grooves 6 which are arranged in the upper wall of the breech 2, and in these shaped grooves 6 said brake rollers 7 can move. Above mentioned construction arrangement will be explained with reference to FIG. 3.

Through the front face of the breech 2 supporting pins 9 are passing through. The body 25 of the fork 12 is terminated by a tapered tongue 28, shown in FIG. 3, which fits into the cavity 15 of the sleeve ending 20. However, the cavity 38 in the sleeve 3 for the fork rod 22 is longer than the length of the fork rod 22. This allows the fork rod 22 to be moved when manually cocked. The sleeve 3 is provided at its other end with an end rod 26, which is inserted into a through opening 36 in the base 4 and is provided at its end with an eccentrically arranged cylindrical ending 27. The function of this ending 27 will be discussed in connection with the trigger mechanism described in FIG. 7. The hook 14 on the base 4 serves to secure the unshown top cover of the gun 1.

Figure 3:
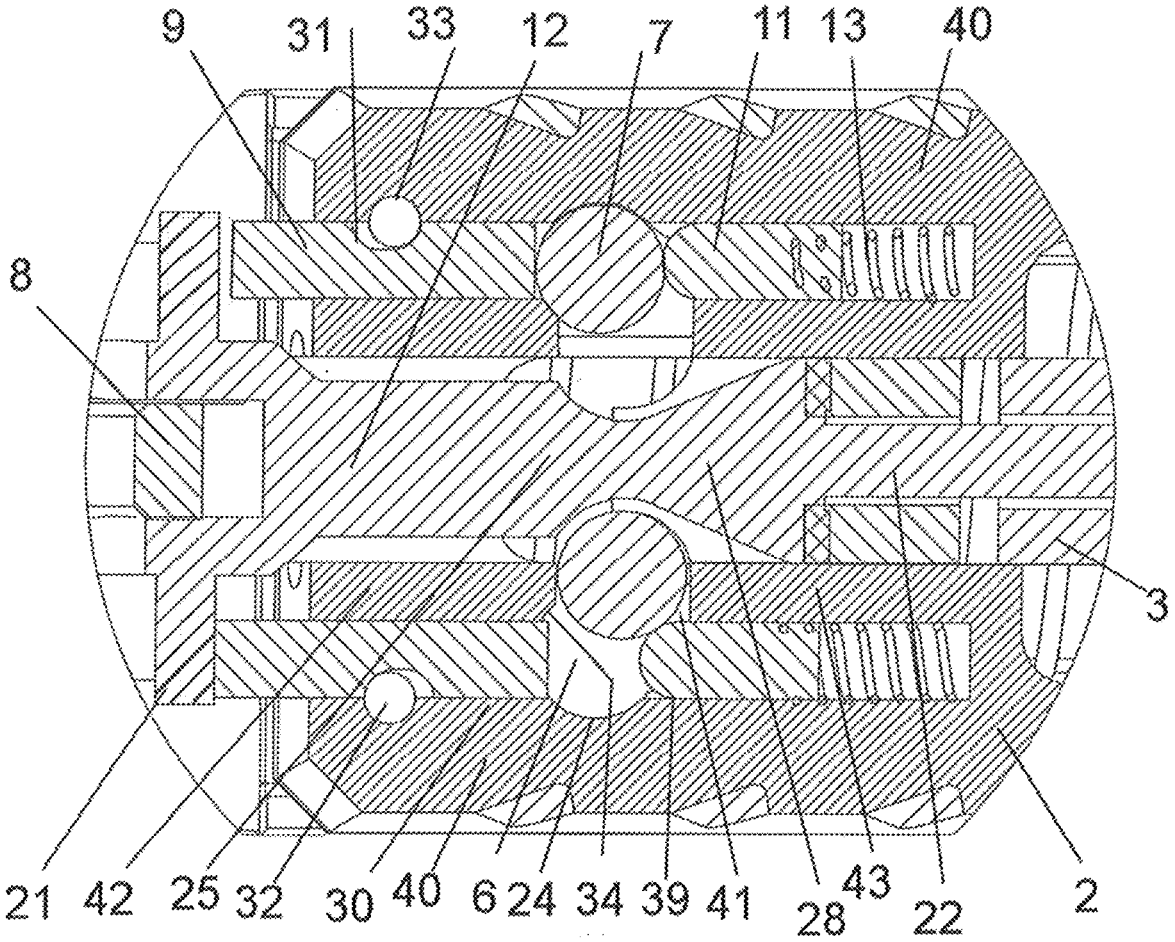
FIG. 3 is a horizontal section through the braking mechanism of the gun from FIG. 2, FIGS. 4*a* to 4*d* represent the staggered movement of the individual parts of the braking mechanism from the rest state during braking to the armed state during firing.

FIG. 3 shows a horizontal section of a detail of the braking mechanism of the gun 1. This consists of the fork 12 described in connection with FIG. 2 and brake rollers 7. It can be seen that the arrangement of brake rollers 7 and their cooperating elements is symmetrical. The lower half of the FIG. 3 represents the rest state of the gun 1 when the gun 1 is locked, and the upper half shows the situation when the braking of the sliding portion of the breech 2 is initiated. In the rest position in the lower half of the FIG. 3, it can be seen that the brake roller 7 is inserted into the inner part of the shaped groove 6, which is bounded towards the axis of the breech 2 by the tongue 28 accommodated in the cavity 15 of the sleeve ending 20 and from the other side it is bounded by the engagement groove 24, whereas on the brake roller 7 the spring-loaded pin 11 is pressed by the compression spring 13. Opposite the brake roller 7 is at this time an unloaded supporting pin 9 and both pins 9, 11 are seated in the cavities 30, 39 of the breech 2.

The front part of the breech 2 includes breech bushings 40 on both flanks, in which two concentric longitudinal cavities 30, 39 are provided opposite each other. The front cavity 30 is open and the rear cavity 39 is closed. These two cavities 30, 39 are separated on the inner wall of the sleeve by a gap 41, and thus the inner wall of cavities is divided into two branches 42, 43, the front branch 42, the rear branch 43. On the inner face of the front branch 42 is on the edge oriented into the cavities 30, 39 an engagement chamfer 34 provided.

The supporting pin 9 is provided with a vertical elongated groove 31 for accommodating the safety pin 32, the remaining half of the safety pin 32 is accommodated in a vertical groove 33 arranged in the flank of the breech 2. It can be seen that the elongated groove 31 in the supporting pin 9 is in contact with the safety pin 32 on its front side, i.e. closer to the mouth of the frame 5. It can also be seen that the engagement groove 24 and the engagement chamfer 34 are not in contact with the brake roller 7 and the spring-loaded pin 11 is only in tangential contact with the brake roller 7.

After the shot, the backlash changes the situation as shown at the top of FIG. 3. The braking roller 7 is pushed away from the tongue 28 into the engagement groove 24, the spring-loaded pin 11 contacts the brake roller 7 and the compression spring 13 is compressed. From the other side, the brake roller 7 abuts the supporting pin 9 and the engagement chamfer 34 and the movement of the supporting pin 9 is stopped by the action of the safety pin 32. It can be seen that the elongated groove 31 in the supporting pin 9 is in contact with the locking safety pin 32 on its rear side, i.e. further away from the mouth of the frame 5. The safety pin 32 also secures the supporting pin 9 against falling out of the housing cavity 30.

After this braking effect, the individual components return to the position shown at the bottom of FIG. 3. The components are returning by the spring 16 which is wound around the barrel 10, as shown in FIG. 2. As soon as the next shot is fired, the whole situation is repeated. As indicated above, in FIG. 3 both positions of brake rollers 7 are shown, but it is clear that in the rest situation brake rollers 7 will be close to the axis of the gun 1, as shown in the lower half, and when the backlash is damped brake rollers 7 will move away from the axis towards the outside of the frame 5, as shown in the upper half.

Before the first shot is fired, the gun must be loaded with the first cartridge, which is done by manually pulling the breech backwards. In doing so, the breech 2 and brake rollers 7 are moved rearwards, brake rollers 7 are pushed against the extending flanks of the tongue 28 of the fork 12 and these deflect brake rollers 7 away from the axis of the gun, and this deflection causes from the opposite side pushing of the spring-loaded pin 11, the brake roller 7 is displaced into the engagement groove 24 and thus is off the axis and out of the sleeve ending 20 and no braking action occurs, as brake rollers 7 cannot press on the sleeve 3 via the sleeve ending 20.

Figure 4B:
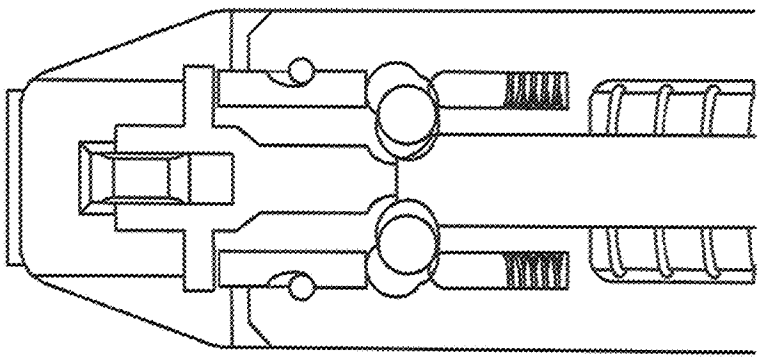
Figure 4D:
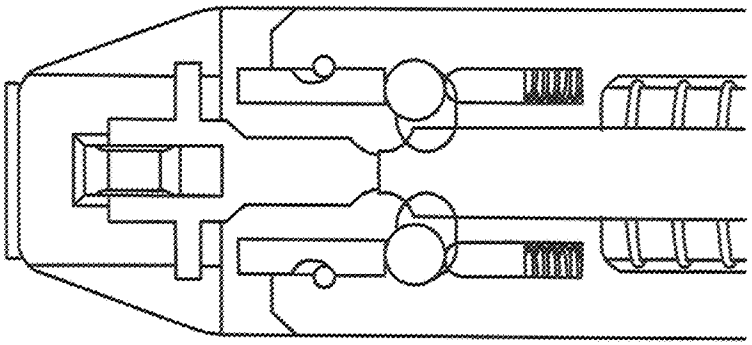
Figure 4A:
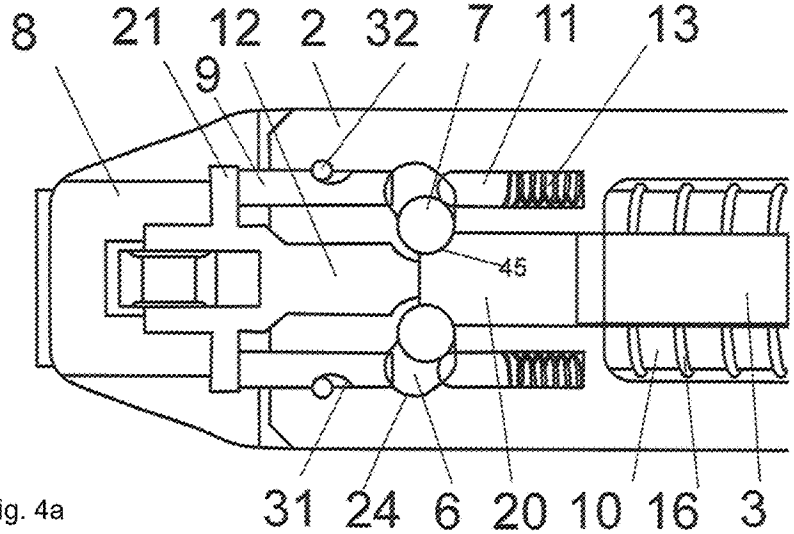

FIGS. 4*a* to 4*d* represent the staggered movement of the individual parts of the braking mechanism from the rest state during braking to the armed state during firing. FIG. 4*a* corresponds to the rest state of the gun 1 when the breech 2 pushes brake rollers 7 arranged in the inner part of the shaped groove 6 against the circular recess 45 of the ending 20 of the sleeve 3. The elongated groove 31 in the supporting pin 9 is in contact with the safety pin 32 on its front side. The supporting pins 9 abut the arms 21 of the fork 12 and are not in contact with brake rollers 7. Brake rollers 7 tangentially abut the spring-loaded pins 11.

FIG. 4*b* corresponds to the condition when the breech 2 is moved backwards by approximately 1 mm and brake rollers 7 are slightly displaced from their extreme position in the inner part of the shaped groove 6 towards the outer part thereof, i.e. towards the engagement groove 24. Supporting pins 9 move slightly away from the arms 21 of the fork 12, although they are still not in contact with brake rollers 7, but they are already approaching them and are already pushing the spring-loaded pins 11.

Figure 4C:
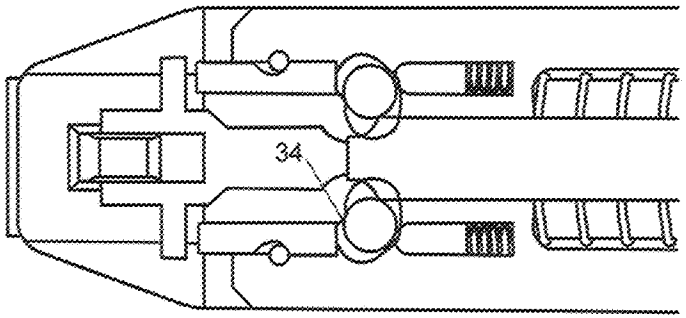

FIG. 4*c* corresponds to a condition when brake rollers 7 are tangentially in contact with the engagement chamfer 34 on the breech 2 and are just about to be moved to the outer part of the shaped groove 6, i.e. to the engagement groove 24. Supporting pins 9 continue to move away from the arms 21 of the fork 12, although they are still not in contact with brake rollers 7, but they are getting even closer to them and continue to push the spring-loaded pins 11.

FIG. 4*d* corresponds to the condition at firing, when the braking mechanism is armed and when brake rollers 7 are already located in the engagement grooves 24 in the outer part of the shaped grooves 6. Supporting pins 9 have moved completely away from the arms 21 of the fork 12, and have come into contact with brake rollers 7, and spring-loaded pins 11 are pressed against them from the other side. When the breech 2 is returned, brake rollers 7 are pushed by spring-loaded pins 11 back to the position shown in FIG. 4*a*.

Figure 5:
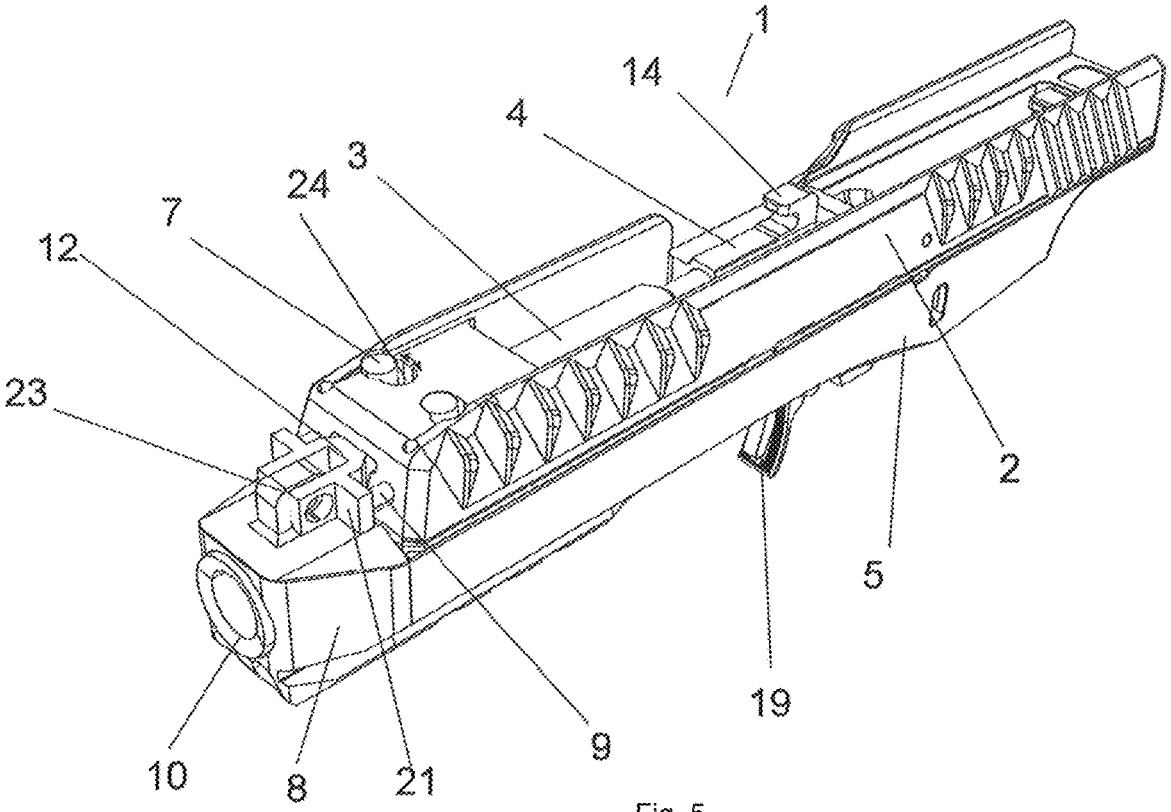
FIG. 5 is a perspective view of the partially covered barrel frame from FIG. 2.

FIG. 5 is a perspective view of the partially covered frame 5 of FIG. 2. It shows the flank of the breech 2 with the engagement grooves 24, which are part of vertical shaped grooves 6 in which the brake rollers 7 move in the direction of the double-sided arrow.

Figure 6:
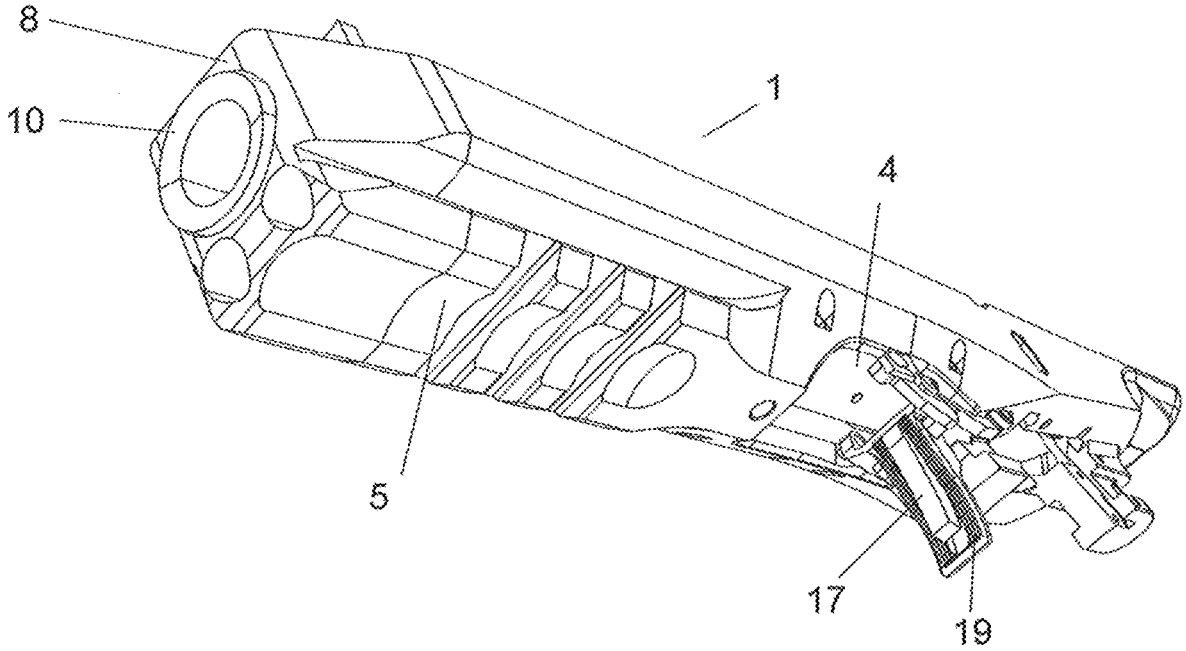
FIG. 6 is a view of the frame from below with the trigger.

FIG. 6 is a perspective view from below of the frame 5 of the gun 1. It can be clearly seen here that in front of the trigger 19 a locking lever 17 of the control arm 18 of the actuation of the brake mechanism described above is located. The control arm 18 will be illustrated in FIG. 8.

Figure 7:
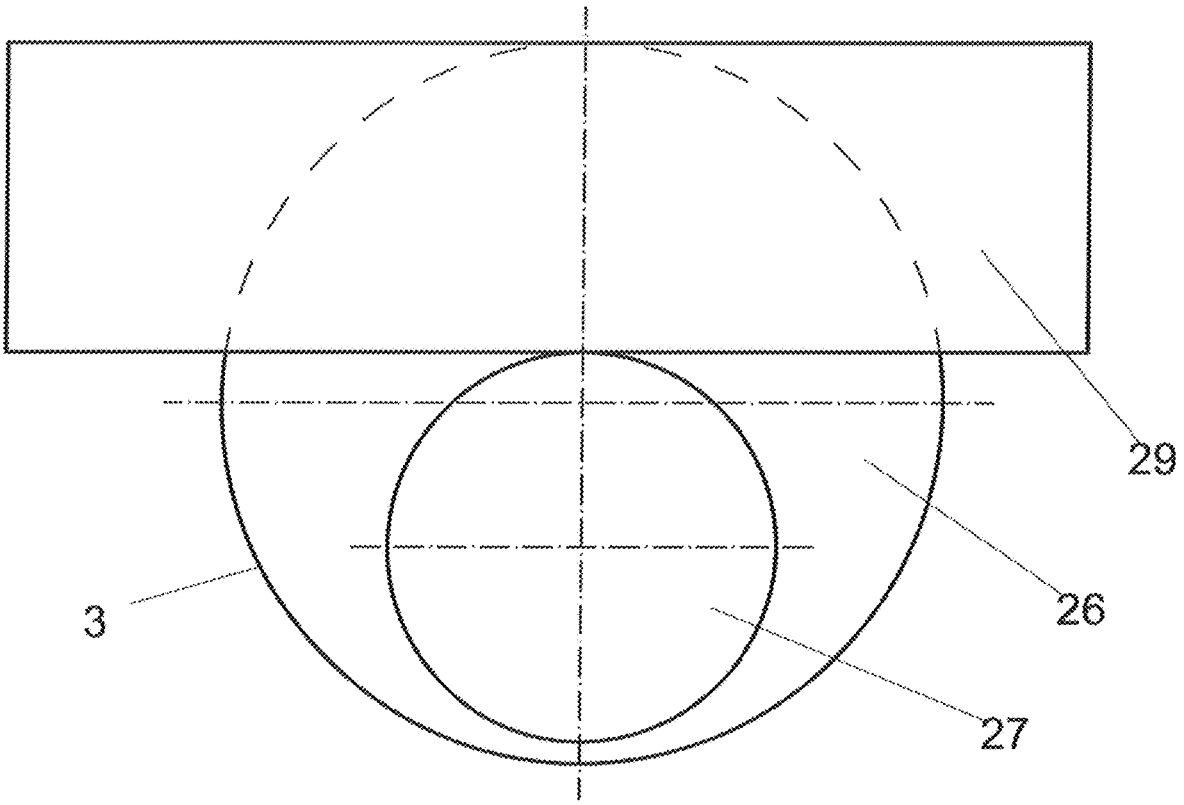
FIG. 7 is a detail of the arrangement of the ending at the head of the end rod.

The control arm 18 for actuating the braking mechanism has a transverse beam 29 at its other end, which is shown in FIG. 7. The arrangement of the end rod 26 in the view on its face is shown. The transverse beam 29 lies on the ending 27 of the end rod 26, and the cylindrical ending 27 is at the face of end rod 26 arranged eccentrically below the center of the end rod 26.

This eccentric arrangement allows, the aforementioned transverse beam 29 to be accommodated on this ending 27. This transverse beam 29 blocks the end rod 26 of the sleeve 3, when the locking lever 17 is pressed and thus brake rollers 7 of the braking mechanism are in the rest position. However, once the transverse beam is actuated as a result of pressing of the locking lever 17 by the control arm 18 above the level of the sleeve 3, the entire braking mechanism is locked in terms of its motion and therefore, upon subsequent pulling of the trigger 19 of the gun 1, the braking mechanism can react to the backlash of the upper part of the frame 5.

Figure 8:
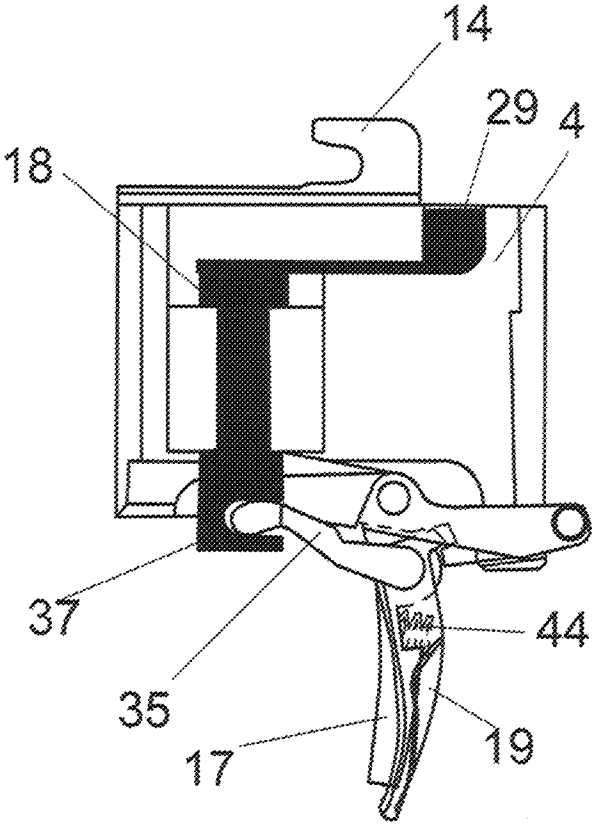
FIG. 8 is a side view of the base with the control arm in a situation when the braking mechanism is locked.

FIG. 8 is a side view of the base 4 with the control arm 18 for actuating the braking mechanism of the gun 1. The base 4 is formed as a shaped block substantially of the width of the cavity in the top of the frame 5, with a shaped groove formed therein laterally to receive the control arm 18. It can be seen that the control arm 18 is provided with a groove 37 at its lower end for accommodating one end of the connecting lever 35, the other end of which is connected to the locking lever 17. In the indicated position, the locking lever 17 is in its rear extremity position and the connecting lever 35 and the control arm 18 are in their lower extremity position with the transverse beam 29 resting on the ending 27 of the end rod 26.

Figure 9:
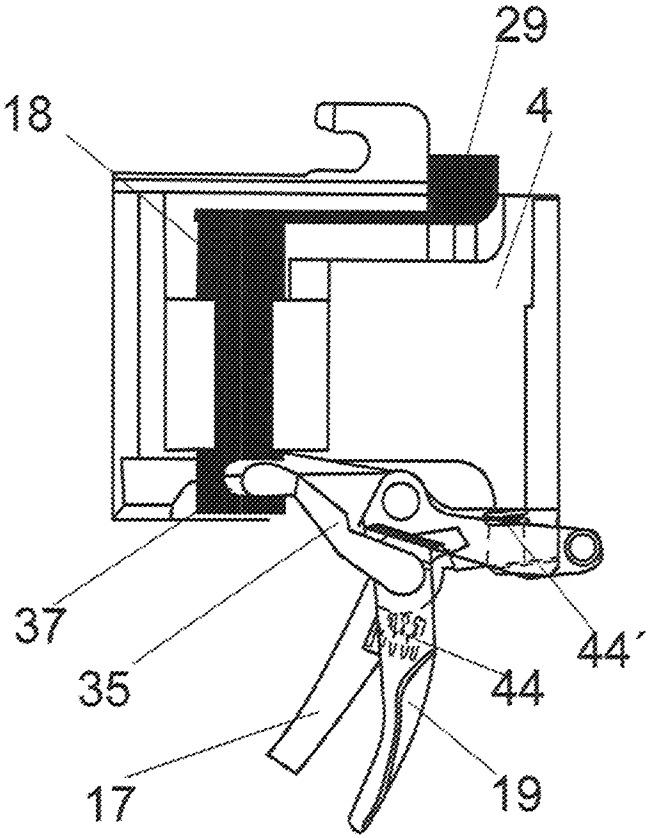

It can be seen in FIG. 9 that as soon as the locking lever 17 is brought to the forward position by means of the springs 44, 44', the connecting lever 35 lifts the control arm 18, thereby lifting the transverse beam 29 and the braking mechanism is armed.

Figure 10:
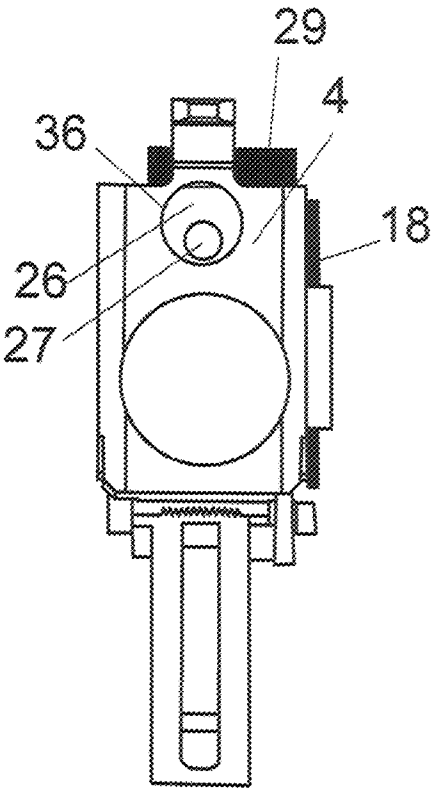
FIG. 9 is a side view of the base with the control arm in the situation when the braking mechanism is armed and FIG. 10 is a front view of the base from FIG. 9.

FIG. 10 is a front view of the base 4, showing that when the transverse beam 29 is in its upper position, the end rod 26 is not blocked.

LIST OF REFERENCE SIGNS

1 gun
2 breech
3 sleeve
4 base
5 frame
6 shaped groove
7 braking roller
8 head
9 supporting pin
10 barrel
11 spring-loaded pin
12 fork
13 compression spring
14 hook
15 ending cavity
16 spring
17 locking lever
18 control arm for locking the braking mechanism
19 trigger
20 sleeve ending
21 fork arm
22 fork rod
23 upper head protrusion
24 engagement groove
25 fork body
26 end rod
27 ending of end rod
28 tongue
29 transverse beam
30 housing cavity
31 elongated groove
32 safety pin
33 vertical groove
34 engagement chamfer
35 connecting lever
36 through opening in base
37 groove
38 sleeve cavity
39 rear cavity
40 breech bushing
41 gap
42 front branch
43 rear branch
44, 44' spring
45 circular recess
52 return spring
53 return spring guide
54 gun barrel from the state of the art
55 striker
56 hammer
57 firing spring
58 cartridge chamber
59 breech from the state of the art

The invention claimed is:

1. Braking mechanism for a gun arranged in a frame and breech of a gun, the frame being provided with a cavity in which a barrel is arranged, comprising:

a fork deposited on an upper projection on a head of a frame via a pin;

arms projecting laterally from a respective side of the fork;

brake rollers;

vertical engagement grooves each for receiving a respective one of the brake rollers in a braking state provided on a flank of the breech of the gun, each vertical engagement groove being a part of a vertical shaped groove arranged in an upper wall of the breech for full or partial reception of the respective one of the brake rollers, depending on whether the braking mechanism is in a rest or a braking position;

spring-loaded pins each arranged at one side of a respective one of the brake roller to press the respective one of the brake roller into a respective one of the vertical shaped grooves in the rest position of the braking mechanism, each spring-loaded pin being associated with a respective compression spring for urging the spring-loaded pin against the respective one of the brake rollers;

supporting pins each abutting a respective one of the arms at one side thereof and abutting another side of a respective one of the brake roller at another side thereof to support the respective one of the brake roller during braking;

breech bushings on both sides of a front part of the breech in which concentric longitudinal front and rear cavities are provided opposite each other, the front cavity in each breech bushing being open and accommodating a respective one of the supporting pins and the rear cavity in each breech bushing being closed and accommodating a respective one of the spring-loaded pins, the front and rear cavities of each breech bushing being separated on an inner wall of the breech bushing by a gap, thereby dividing the inner wall of the front and rear cavities thereof into a front branch and a rear branch, an inner face of the front branch thereof being on an edge facing the front and rear cavities thereof;

an engagement chamfer provided at each front branch for abutting a respective one of the brake rollers during braking;

a tapered tongue terminating a body of the fork for controlling a position of the brake rollers in the shaped grooves;

circular recesses to receive brake rollers in the rest position of the mechanism;

a fork rod that passes into the sleeve cavity of a sleeve and is arranged behind the tapered tongue, the sleeve cavity being longer than the fork rod;

an end rod provided at another end of the sleeve, which is inserted into a through opening in a base, the base being a shaped block an substantially as wide as the cavity of the frame;

a cylindrical ending at a face of the end rod arranged eccentrically below a center of the end rod; and a locking lever of a control arm for actuating the braking mechanism placed in front of a trigger, the control arm being provided with a control arm groove for inserting a connecting lever, which is connected at an end thereof to the locking lever and, at an opposite end thereof, the control arm is provided with a transverse beam for blocking the end rod, which is accommodated above an ending of the end rod, wherein each brake roller is inserted into the shaped groove, which is bounded on one side by a tongue and on another side by an engagement groove, and wherein each supporting pin is provided with a vertical elongated groove for accommodating a safety pin for stopping movement of the supporting pin during braking, while a remaining half of each safety pin is placed in a vertical groove arranged in a side of the breech.

* * * * *